US006913263B2

(12) United States Patent
Fort, II

(10) Patent No.: US 6,913,263 B2
(45) Date of Patent: Jul. 5, 2005

(54) TARGET HOLDING DEVICE

(75) Inventor: W. Grady Fort, II, Mason, TX (US)

(73) Assignee: Daisy Manufacturing Company, Rogers, AZ (US)

( * ) Notice: Subject to any disclaimer, the term of this patent is extended or adjusted under 35 U.S.C. 154(b) by 0 days.

(21) Appl. No.: 10/615,943

(22) Filed: Jul. 10, 2003

(65) Prior Publication Data

US 2005/0006848 A1 Jan. 13, 2005

(51) Int. Cl.[7] ..... F41J 1/10
(52) U.S. Cl. ..... 273/406; 273/407
(58) Field of Search ..... 273/406–408, 273/403, 404; 321/309, 310, 28, 67, 82, 294, 307, 308

(56) References Cited

U.S. PATENT DOCUMENTS 1,385,086 A * 7/1921 Maranville ..... 221/294
1,689,393 A * 10/1928 Klein ..... 221/308
2,481,495 A * 9/1949 Borthwick ..... 221/310
2,768,775 A * 10/1956 Houser ..... 221/185
4,199,078 A * 4/1980 Ramirez ..... 221/309
5,087,053 A * 2/1992 Head ..... 273/359
5,261,674 A * 11/1993 Allison ..... 273/359
6,719,306 B2 * 4/2004 White ..... 280/47.26

* cited by examiner

*Primary Examiner*—Mark S. Graham
(74) *Attorney, Agent, or Firm*—Pillsbury Winthrop Shaw Pittman LLP

(57) ABSTRACT

A target holding device is disclosed. Preferred embodiments of the invention includes one or more of the following features. First, an automatic reloading feature of the invention allows a first replacement target stored in a target storage region of the device to slide down into a target exposure region of the device after an initially exposed target in the target exposure region is destroyed. Second, a ricochet feature of the invention deflects an incoming projectile to ricochet in a direction away from the shooter of the projectile. Third, a spare target viewing feature enables the shooter to determine whether additional targets are present within the target storage region. Fourth, the mounting feature of the invention positions the target storage region above the target exposure region. Fifth, the target storage region of the device has the capacity to store two or more additional targets.

15 Claims, 6 Drawing Sheets

TARGET HOLDING DEVICE

BACKGROUND

1. Field of the Invention

The present invention relates generally to an article dispensing system and, more particularly, to a target holding device.

2. Background of the Invention

A number of target dispensing systems are available today. Some of these target dispensing systems are used by shotgun users to throw one or more clay discs that are used as moving targets for the users to improve their shooting skills. A sophisticated system can toss one or more targets in the air, and reload additional targets automatically. Using an automatic target reloading system, a shotgun user does not have to constantly load additional targets, and can concentrate his efforts on shooting. The automatic target reloading and throwing system, however, can be expensive and is not suitable for rifle or pistol users.

There are also stationary shooting systems available for rifle and pistol shooting, which use non-breakable targets. These targets, usually metal, are attached to, and rotate around, a central rod when struck by the projectile. After being stuck and swung away, they must then reset into the beginning ready position for further target practice. These mechanical systems do not provide the psychological excitement of using breakable targets, do not work well for low impact BB gun use, and are subject to ricochets. Furthermore, typical BB guns users who are young adults or children would not have the resources to afford such system.

Accordingly, there is a need for a relatively inexpensive target holding device that can automatically reload a breakable stationary replacement target after a first target is destroyed, one suitable for BB gun use, and one that minimizes potential ricochets.

SUMMARY OF THE INVENTION

The invention is a target holding device. A preferred embodiment of the invention includes a target exposure region and a target storage region. The target exposure region is configured to display a first target. A stopping feature disposed near the target exposure region maintains the first target within the target exposure region. The target storage region is located above the target exposure region. The target storage region is configured to store at least one additional target at a position immediately above the first target so that when the first target is destroyed, the at least one additional target drops into the target exposure region to replace the first target. Preferably, the target exposure region is configured to hold two or more additional targets. For example, the target exposure region can be configured to hold five additional targets. Preferably, the target exposure region has a substantially inverted U-shape. Preferably, the target exposure region is configured to expose a substantially disc-shape target.

Another embodiment of the invention is a target holding device that includes a housing and a mounting member. The housing has a target exposure region, a guide rail, and a target storage region. The mounting member is attached to the housing. The mounting member positions the housing so that the target storage region is located above the target exposure region. The guide rail is disposed within the housing along the target storage region and the target exposure region. The guide rail is configured to allow movement of targets from the target storage region to the target exposure region. Preferably, the target holding device further includes one or more windows disposed on a front wall of the housing in the target storage region. Preferably, each of the windows corresponds with a position of a target within the target storage region. Preferably, The housing includes a V-shape front wall. Preferably, the housing includes a rough surface on the front wall. The mounting member can include at least one leg. Preferably, each leg of the mounting member includes a bent region. In a variation, the mounting member includes a chain.

In another embodiment of the target holding device that includes a housing and a mounting member. The housing has a left wall, a right wall substantially parallel to the left wall, a back wall substantially perpendicular to the left wall and the right wall, and a front wall joining the left wall and the right wall. The left wall and the right wall extend from a target storage region of the housing to a target exposure region of the housing. The back wall and the front wall extend fully in the target storage region but forms an inverted U-shape opening in the target exposure region. The mounting member is attached to the housing. The mounting member is configured to position the target storage region above the target exposure region. The housing can include a translucent wall. Alternatively, the housing can include one or more windows. Preferably, the front wall of the housing includes a surface configured to ricochet projectiles that impact upon the surface at an angle relative to an incoming direction of the projectile. Preferably, the front wall of the housing has a V-shape surface.

BRIEF DESCRIPTION OF PREFERRED EMBODIMENTS

DETAILED DESCRIPTION OF PREFERRED EMBODIMENTS

Figure 1:
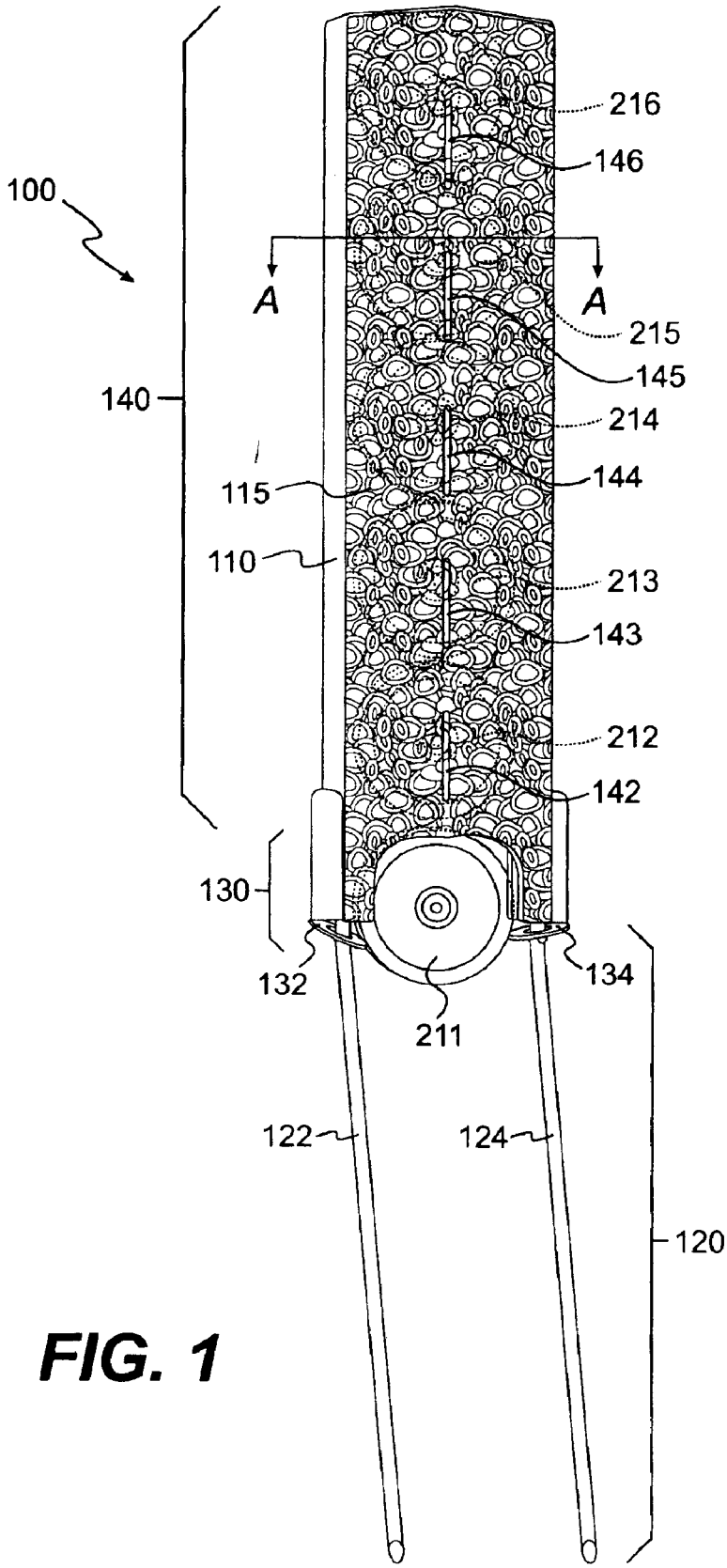
FIG. 1 is a perspective view of a preferred embodiment of the target holding device of the invention.

The preferred embodiment of the invention is shown in FIGS. 1–4. Target holding device 100 shown in FIGS. 1–4 is configured to hold disc targets for target shooting with BB guns. It is noted that the preferred embodiment as shown can be modified in a number of ways. For example, other embodiments of the invention can be configured for target shooting with more powerful firearms, including many types of handguns and rifles.

Device 100 includes housing 110 and mounting member 120. Housing 110 is configured to display first target 211 and to store one or more additional targets 212, 213, 214, 215, and 216. Mounting member 120 is configured to support housing 110 so that first target 211 is visible to a shooter and additional target 212 can take the position of first target 211 after first target 211 is destroyed by a projectile fired by the shooter.

Figure 2:
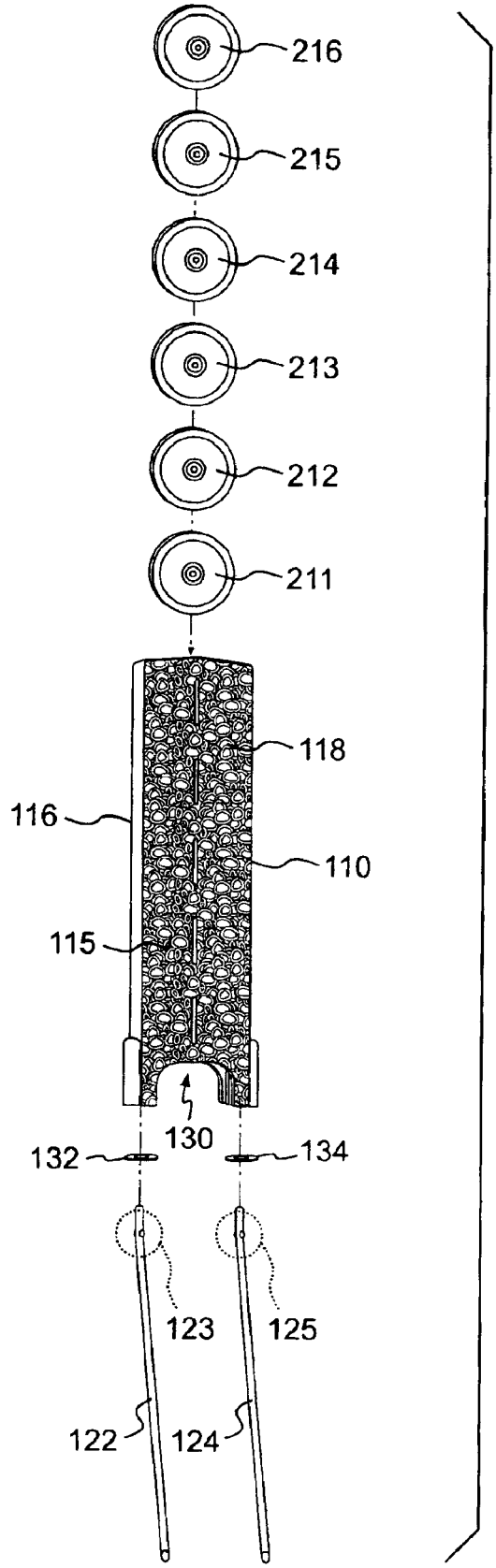
FIG. 2 is an exploded view of the target holding device shown in FIG. 1.
Figure 4:
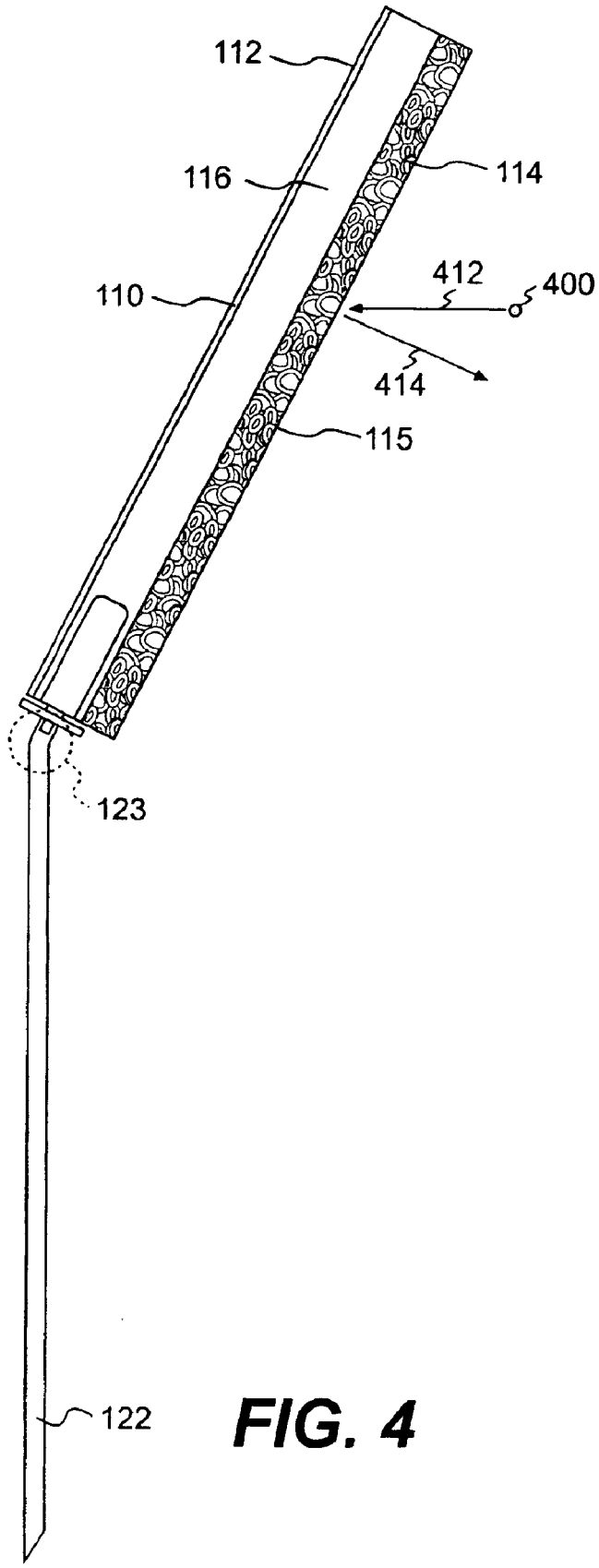
FIG. 4 is a side view of the target holding device.

As shown in FIG. 1, mounting member 120 of the preferred embodiment of the invention includes left leg 122 and right leg 124. In other embodiments, mounting member 120 may include only one leg or more than two legs. Legs 122, 124 can be inserted into the ground or a hay bale. Preferably, as shown in FIGS. 2 and 4, legs 122, 124 are slightly bent at bent regions 123 and 125 at an angle such that when they are mounted roughly perpendicular to the ground, housing 110 is angled slightly forward. This orientation of housing 110 helps deflect projectiles to ricochet downward to the ground.

Figure 5:
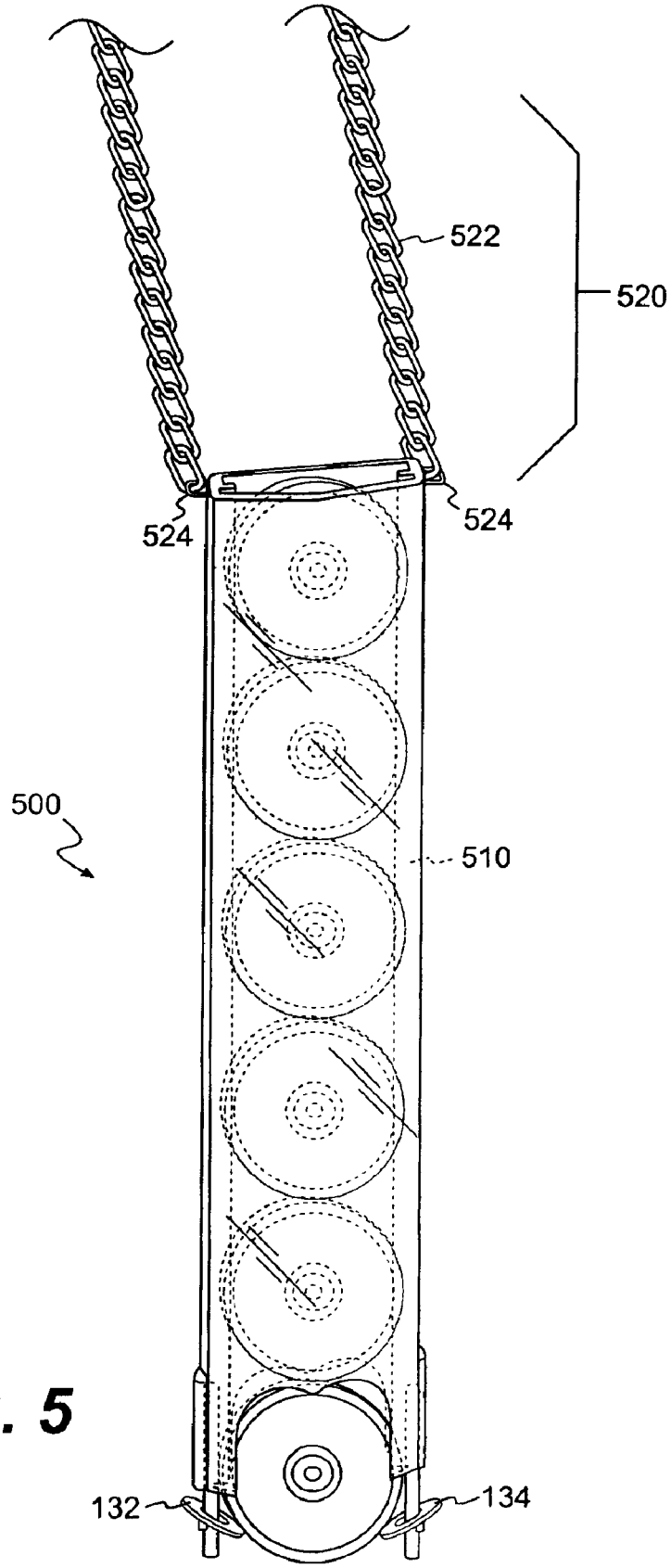
FIG. 5 is an alternative design of the target holding device.

In other embodiments, mounting member 120 can be a hanging device. For example, as shown in FIG. 5, mounting member 520 of device 500 includes chain 522 and ears 524. Chain 522 can be hung, for example, on a tree branch or other structure. Note that housing 510 of device 500, in some embodiments, can have a translucent appearance. In this configuration, a shooter can see the number of targets still remaining.

Figure 6:
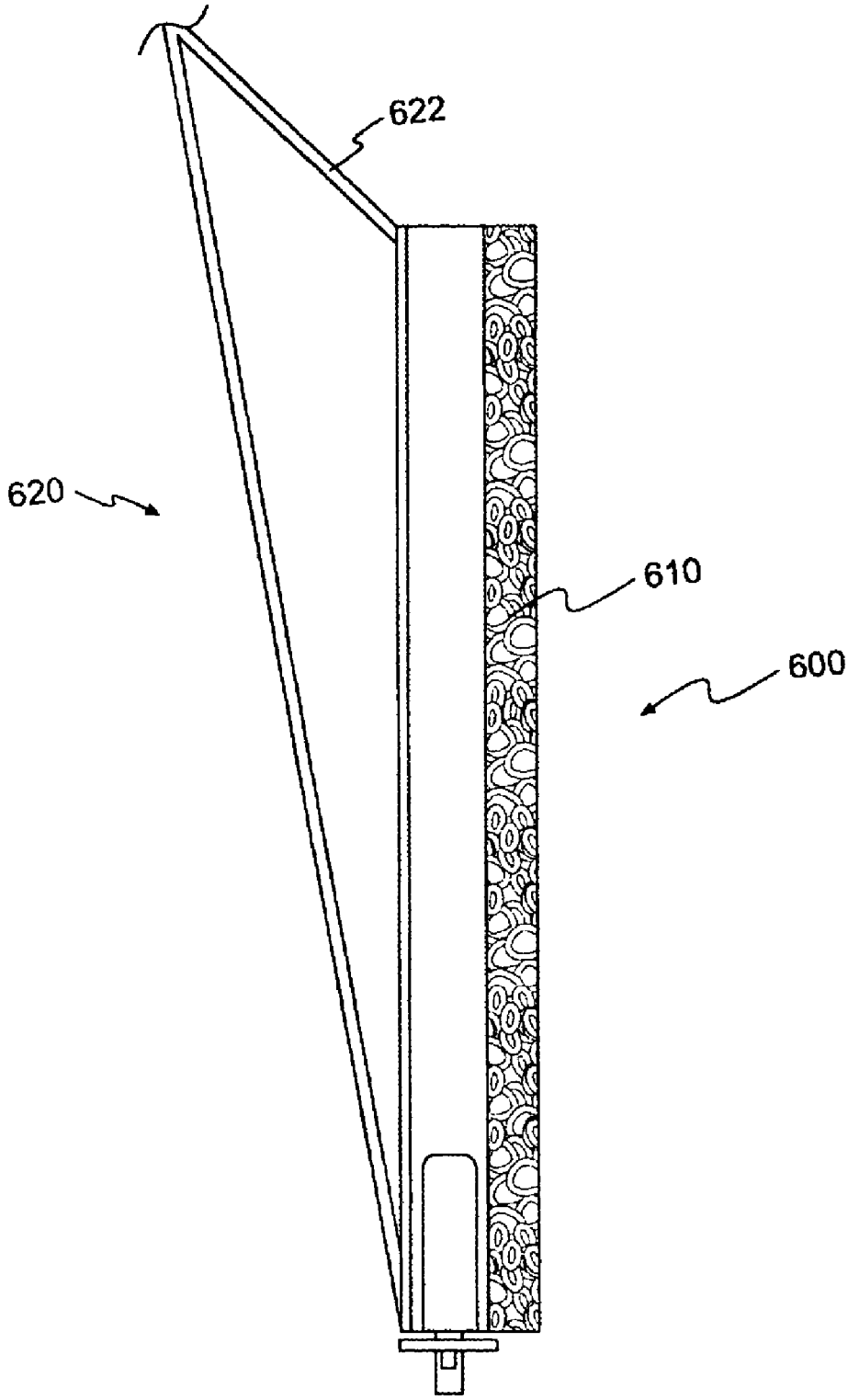
FIG. 6 is another alternative design of the target holding device.

In another embodiment shown in FIG. 6, mounting member 620 of device 600 includes bracket 622 that can be attached to another structure. Preferably, mounting member 620 can position device 100 such that housing 610 leans slightly forward.

In the preferred embodiment shown in FIG. 1, housing 110 of device 100 can store up to six targets 211, 212, 213, 214, 215, and 216. Housing 110 includes target exposure region 130 and target storage region 140. Target exposure region 130 exposes all or substantially all of target 211. One or more stopping features 132, 134 prevent target 211 from slipping down and out of housing 110. Preferably, as shown in FIG. 1, target exposure region 130 is configured to display a substantially disc-shape target. Preferably, target exposure region 130 has a substantially inverted U shape as shown.

Target storage region 140 contains targets 212, 213, 214, 215, and 216. Preferably, target storage region 140 includes optional windows 142, 143, 144, 145, and 146. Each of windows 142, 143, 144, 145, and 146 is configured so that a shooter, at a distance away from device 100, can determine whether there are any target present within target storage region 140 behind the windows.

Housing 110 is made of materials that can withstand the force associated with projectiles that impact upon housing 110. Preferably, housing 110 is made of a tough plastic. Other materials, including metals, alloys, hard wood, and the like, may also be used to make housing 110 depending on the type of projectiles.

Preferably, the width of each of windows 142, 143, 144, 145, and 146 is narrower than about 2 mm. This width is designed to be narrower than the diameter of BBs fired by BB guns. The typical diameter of BBs is about 2 mm. The length of each of windows 142, 143, 144, 145, and 146 is preferably longer than 2 mm but shorter than the diameter of the disc targets. This length exposes more of the stored targets to facilitate the shooter to determine the presence of targets. Preferably, targets 211, 212, 213, 214, 215, and 216 have bright colors.

In operation, when target 211 is destroyed by a projectile fired by the shooter, target exposure region 130 becomes available to accept another target. Due to gravity, the next target, e.g., target 212, slides down to occupy target exposure region 130. Target 212 is then held in place within target exposure region 130 by stopping features 132, 134. Due to gravity, targets 213, 214, 215, and 216 then each slides down one position so that each can be seen through windows 142, 143, 144, and 145, respectively. At this moment, window 146 reveals no target.

Similarly, when target 212 is subsequently destroyed, target 213 slides down to target exposure region 130. The remaining targets 214, 215, and 216 then each slides downwardly one position, and each can be seen through windows 142, 143, and 144, respectively.

When the last target, target 216, is exposed in target exposure area 130, none of windows 142, 143, 144, 145, and 146 would show any remaining target. This would help remind the shooter that it is time to reload device 100 with new targets.

Figure 3:
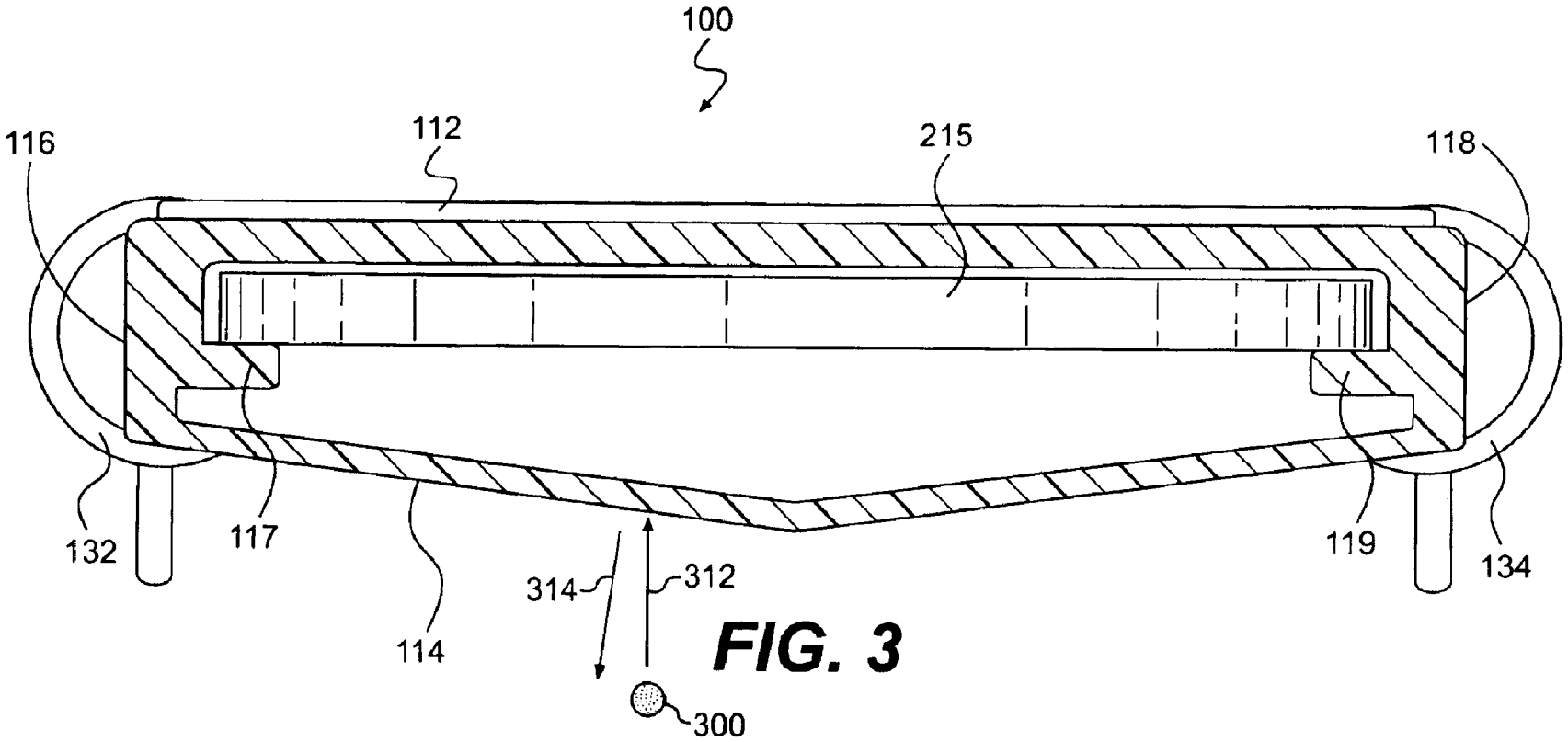
FIG. 3 is a cross-sectional view along line A—A shown in FIG. 1.

As shown in FIG. 3, housing 110 includes back wall 112, front wall 114, left side wall 116, left guide rail 117, right side wall 118, and right guide rail 119. Left guide rail 117 and right guide rail 119 are optional. Although the preferred embodiment depicted in FIGS. 1–4 includes two guide rails, in other embodiments, housing 110 can include one or no guide rail.

In the preferred embodiment shown in FIGS. 1–4, targets 211, 212, 213, 214, 215, and 216 can be loaded into device 100 as follows. First, target 211 is inserted into housing 110 between back wall 112 and guide rails 117, 119. If housing 110 is held in a position where target exposure region 130 is below target storage region 140, gravity would facilitate target 211 to slide into target exposure region 130. Target 211 is held in place by stopping features 132, 134. Although two stopping features are depicted in FIGS. 1–4, only one of them is necessary to implement the invention. As shown in FIGS. 1–4, stopping features 132 and 134 may be disc-like members such as washers that can be attached to mounting legs 122 and 124. In other embodiments of the invention, stopping features 132 and 134 may be integrally molded as part of the bottom extremity of housing 110.

After target 211 is inserted, each of targets 212, 213, 214, 215, and 216 can be inserted into housing 110 in the same manner. As shown in FIG. 1, when targets 211, 212, 213, 214, 215, and 216 are loaded into housing 110, only target 211 is visible in its entirety in target exposure region 130. Through optional windows 142, 143, 144, 145, and 146, each of targets 212, 213, 214, 215, and 216, respectively, is partially visible.

Front wall 114 is preferably not perpendicular to side walls 116 and 118. Preferably, as depicted in FIG. 3, front wall 114 has a roughly V-shaped cross section. The V-shape features allows projectile 300 (e.g., a BB) that impacts upon front wall 114 in direction 312 to be ricochet off in direction 314, which is not toward the shooter of the projectile. In addition, as shown in FIG. 4, the unique bent in bent region 123 and bent region 125 (see FIG. 2) associated with mounting legs 122 and 124 further help ricochet projectile 400 that comes in direction 412 to the ground surface in direction 414.

Another purpose of the V-shaped cross section, in addition to guiding ricochets, is to provide a way to isolate the targets within the construct so as to minimize transfer of impact vibrations. In other words, as shown in FIG. 3, notice guide rails 117, 119 capture the targets, while the V-shape front wall 114 can act as an energy absorber to prevent breakage from shock.

Preferably, as depicted in FIGS. 1, 2, and 4, surface 115 of front wall 114 is not smooth. For example, surface 115 preferably includes a rough texture. The rough texture help absorbs impact energy associated with projectile 300. The absorption of the energy reduces potential damage to housing 110 and the targets. Preferably, surface 115 is made of a resilient material that can withstand the impact force associated with projectile 300. Thus, surface 115 should be strong enough to protect targets that are located within target storage region 140. In this manner, a projectile that was intended for target exposure region 130 but misfired upon surface 115 would not damage any of the targets within target storage region 140.

FIGS. 1–6 described above depicted several preferred embodiments of the invention. Other embodiments of the invention have been contemplated. Each embodiment of the invention preferably includes one or more features as follows.

First, the automatic reloading feature allows a first replacement target (e.g., target 212) stored in the target storage region to slide down into the target exposure region after an initially exposed target (e.g., target 211) is destroyed. The first replacement target is then held in place in the target exposure region, visible to the shooter, while the rest of replacement targets are concealed within the target storage region. As the now visible first replacement target (e.g., target 212) is broken from a projectile fired by the shooter, the next replacement target (e.g., target 213) drops into place. As it drops down from gravity, each replacement target is stopped in the target exposure region by one or more protrusions (e.g., stopping features 132, 134) which may be swaged on washers, molded protrusions, inserts within the molded main body, or similar method of halting the downward movement of the replacement target.

The second feature is the ricochet feature. The ricochet feature can be provided using one or more of the following configurations. First, the front wall (e.g., front wall 114) of the housing is angled on each side to form a shallow "V." Alternatively, the front wall of the housing can be configured to form a curve instead of the V shape. As a projectile (e.g., projectile 300 incoming in direction 312) strikes the front wall, the projectile is deflected sideways (e.g., in direction 314). Second, the mounting member (e.g., legs 122 and 124 or bracket 622) positions the housing at an angle (see FIGS. 4 and 6). This configuration deflects the projectile (e.g., projectile 400 incoming in direction 412) downward to the ground (e.g., in direction 414). A combination of these two design features causes the projectile to move down and away from the shooter. Moreover, a rough texture on the front surface (e.g., surface 115) can absorb energy from the projectile, thus lowering velocity and strength of ricochets.

The third feature is the space target viewing feature. This feature can include one or more windows or sight ports (e.g., windows 142, 142, 144, 145, and 146) that are present on the housing. The windows or sight ports are preferably narrow vertical slots that allow the shooter to see how many targets remain within the target storage region. The narrow width does not allow a projectile to go through, yet any target within the target storage region, can be seen, especially if the targets are florescent colored discs. An alternative to the window design is to use a translucent material for the housing.

The fourth feature is the mounting member which can be legs or brackets. Mounting legs allow the target holding device of the invention to be mounted in the ground, hay bales, on wood, etc. at the proper angle and height. The legs may be wire-form metal, fiberglass, or injection molded plastic. They may include the "stopping features" that halt downward target movement. The stopping features may be integral parts of the legs. The mounting legs are preferably slightly bent (e.g., bent regions 123, and 125) so that when they are secured into the ground surface (or hay bale) at about right angles to the ground surface, the housing of the target holding device forms an angle other than 90 degrees with the ground surface.

The fifth feature is the capacity of the target storage region of the target holding device. In the embodiment shown in FIGS. 1–4, device 100 is configured to hold six targets. By extending or shortening the length of housing 110, device 100 can be made to hold a different number of targets.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A target holding device comprising:

a housing having a target exposure region and a target storage region, wherein the housing comprises a front wall and a back wall, the front wall has a V-shaped cross section;

a mounting member attached to the housing, wherein the mounting member positions the housing so that the target storage region is located above the target exposure region; and a guide rail disposed within the housing along the target storage region and the target exposure region, wherein the guide rail is configured to allow movement of targets from the target storage region to the target exposure region.

2. The target holding device of claim 1, further comprising one or more windows disposed on a front wall of the housing in the target storage region.

3. The target holding device of claim 2, wherein each of the windows corresponds with a position of a target within the target storage region.

4. The target holding device of claim 2, wherein each of the windows has a short dimension and a long dimension.

5. The target holding device of claim 1, wherein the front wall includes a plurality of windows, each of the plurality of windows is configured to expose a portion of a target behind the front wall.

6. The target holding device of claim 1, wherein the housing includes a rough surface.

7. The target holding device of claim 1, wherein the mounting member includes at least one leg.

8. The target holding device of claim 7, wherein the at least one leg includes a bent region.

9. The target holding device of claim 1, wherein the mounting member includes a chain.

10. A target holding device comprising:

a housing having a left wall, a right wall substantially parallel to the left wall, a back wall substantially perpendicular to the left wall and the right wall, and a front wall joining the left wall and the right wall, the left wall and the right wall extend from a target storage region of the housing to a target exposure region of the housing, the back wall and the front wall extend fully in the target storage region but forms an inverted U-shape opening in the target exposure region, wherein the front wall has a V-shaped cross section; and a mounting member attached to the housing, wherein the mounting member is configured to position the target storage region above the target exposure region.

11. The target holding device of claim 10, wherein the housing includes a translucent wall.

12. The target holding device of claim 10, wherein the front wall of the housing includes a surface configured to ricochet projectiles that impact upon the surface at an angle relative to an incoming direction of the projectile.

13. The target holding device of claim 12, wherein the front wall includes a plurality of windows, each of the plurality of windows is configured to expose a portion of a target behind the front wall.

14. The target holding device of claim 10, wherein the front wall includes at least one window.

15. The target holding device of claim 10, wherein the front wall includes a rough surface.

* * * * *

UNITED STATES PATENT AND TRADEMARK OFFICE

CERTIFICATE OF CORRECTION

PATENT NO. : 6,913,263 B2
DATED : July 5, 2005
INVENTOR(S) : W. Grady Fort, II

It is certified that error appears in the above-identified patent and that said Letters Patent is hereby corrected as shown below:

Title page,
Item [73], Assignee, delete "Arizona" and replace with -- Arkansas --.

Signed and Sealed this

Eleventh Day of October, 2005

JON W. DUDAS
*Director of the United States Patent and Trademark Office*